US011739927B2

(12) United States Patent
Crick

(10) Patent No.: US 11,739,927 B2
(45) Date of Patent: Aug. 29, 2023

(54) LAMP UNIT FOR OUTDOOR USE

(71) Applicant: SIGNIFY HOLDING B.V., Eindhoven (NL)

(72) Inventor: Guido Clement Maria Crick, Hove (BE)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/791,081

(22) PCT Filed: Jan. 4, 2021

(86) PCT No.: PCT/EP2021/050012

§ 371 (c)(1),
(2) Date: Jul. 6, 2022

(87) PCT Pub. No.: WO2021/140064

PCT Pub. Date: Jul. 15, 2021

(65) Prior Publication Data

US 2023/0023685 A1 Jan. 26, 2023

(30) Foreign Application Priority Data

Jan. 9, 2020 (EP) ..... 20150848

(51) Int. Cl.

| | |
|---|---|
| ***F21V 31/00*** | (2006.01) |
| ***F21V 7/04*** | (2006.01) |
| ***F21V 17/06*** | (2006.01) |
| ***F21V 21/02*** | (2006.01) |
| ***F21W 131/10*** | (2006.01) |

(52) U.S. Cl.
CPC ..... *F21V 31/005* (2013.01); *F21V 7/04* (2013.01); *F21V 17/06* (2013.01); *F21V 21/02* (2013.01); *F21W 2131/10* (2013.01)

(58) Field of Classification Search
CPC ..... F21V 31/005; F21V 7/04; F21V 21/02; F21V 17/06
See application file for complete search history.

(56) References Cited

U.S. PATENT DOCUMENTS

| | | | | |
|---|---|---|---|---|
| 5,908,236 | A * | 6/1999 | Lueken | F21V 29/15 362/372 |
| 7,011,436 | B2 * | 3/2006 | Riebling | F21V 31/04 362/267 |
| 7,524,078 | B1 * | 4/2009 | Pressel | F21S 8/022 362/374 |
| 9,605,809 | B1 | 3/2017 | Ernst | |
| 2006/0262542 | A1 * | 11/2006 | Ibbitson | F21V 31/00 362/372 |

FOREIGN PATENT DOCUMENTS

| | | | |
|---|---|---|---|
| CN | 201277508 | Y | 7/2009 |
| CN | 203703829 | U | 7/2014 |
| CN | 107606508 | A | 1/2018 |
| CN | 107701959 | A | 2/2018 |
| EP | 2072887 | A2 | 6/2009 |

* cited by examiner

*Primary Examiner* — Arman B Fallahkhair

(57) ABSTRACT

A lamp unit (100) for outdoor use is provided. The lamp unit comprises a gasket with a step-vise shape configured to provide a sealing effect in two perpendicular directions in order to prevent water ingress. The gasket is further configured to press a reflector (120) towards a lid element (130) in order to minimize the gap between them, thus ensuring a consistent lighting output.

13 Claims, 3 Drawing Sheets

LAMP UNIT FOR OUTDOOR USE

CROSS-REFERENCE TO PRIOR APPLICATIONS

This application is the U.S. National Phase application under 35 U.S.C. § 371 of International Application No. PCT/EP2021/050012, filed on Jan. 4, 2021, which claims the benefit of European Patent Application No. 20150848.8, filed on Jan. 9, 2020. These applications are hereby incorporated by reference herein.

FIELD OF THE INVENTION

The present invention relates to a lamp unit, in particular a lamp unit for outdoor use.

BACKGROUND OF THE INVENTION

Lamp units for outdoor use continue to be appreciated and desired. However, lamp units for this purpose need to withstand weather conditions related to outdoor use. Hence, efficient solutions to problems related to outdoor use is still sought after in order to provide the required lighting properties of the lamp unit.

It should be noted that water ingress into lamps may be detrimental to the components of the lamp, affect the service time of the lamp and/or negatively influence the lighting properties of the lamp. In particular, it is desirable to seal the lamps in an efficient manner for preventing water ingress while at the same time providing a desired lighting output.

Examples in the prior art in this field tries to solve the problem of water ingress by disclosing the use of e.g. rubber rings and rubber sealing pads arranged between exterior and interior parts of the lamps to create a seal.

However, these solutions proposed in the prior art to this problem are generally unsatisfactory, and there is a wish to provide an efficient sealing solution to prevent water ingress into the lamp while at the same time providing a desired lighting output of the lamp.

SUMMARY OF THE INVENTION

It is of interest to provide an alternative solution to lamps or lamp arrangements of the prior art in order to improve the sealing effect to prevent water ingress more efficiently, while providing a desired lighting output of the lamp.

This and other objectives are achieved by the lamp unit having the features in the independent claim. Preferred embodiments are defined in the dependent claims.

Hence, according to a first aspect of the present invention, there is provided a lamp unit, wherein the lamp unit comprises at least one light source, and a reflector configured to reflect the light emitted from the at least one light source. The reflector elongates along a principal axis, A, and comprises a first opening for an output of the light emitted from the at least one light source. The reflector further comprises an engagement element arranged circumferentially around the reflector in a plane perpendicular to the principal axis, A. The lamp unit further comprises a lid element arranged on the first opening of the reflector, the lid element comprising a flange arranged at a rim of the reflector at the first opening. The lamp unit further comprises a housing at least partially enclosing the reflector in a circumferential direction of the principal axis, A. The lamp unit also comprises a fastening element biasedly engaged with the housing, wherein the flange is at least partially arranged between the fastening element and the housing in a direction parallel to the principal axis, A. The fastening element is configured to bias the flange in a direction parallel to the principal axis, A. The lamp unit further comprises a gasket arranged circumferentially around the reflector in a plane perpendicular to the principal axis, A. The gasket has a step-wise shape in a cross-section of the plane. The gasket comprises a first portion extending transverse, for example perpendicular, to the principal axis, A, and being arranged between the flange and the housing in a direction parallel to the principal axis, A. The gasket further comprises a second portion extending along the principal axis, A, and being arranged between the housing and the flange in a direction perpendicular to the principal axis, A. In this context the expression "along" means the second portion can extend at an angle with the principal axis of at the most 20 degrees, for example 10 degrees or 5 degrees, or parallel with the principal axis. The gasket further comprises a third portion extending transverse to the principal axis, A, and being engaged with the engagement element. In this context the expression "transverse" means the third portion can extend at an angle with the normal to the principal axis of at least 70 degrees, for example 80 degrees or 85 degrees, or perpendicular at 90 degrees with the principal axis The fastening element is configured to clamp the first portion between the flange and the housing in a direction essentially parallel to the principal axis, A, and to clamp the second portion between the housing and the flange in a direction perpendicular to the principal axis, A. The third portion, via the engagement element, is configured to press the reflector towards the lid element.

According to a second aspect of the present invention, there is provided a lighting arrangement comprising two lamp units as described according to the first aspect of the present invention. The lamp units are oppositely arranged in the lighting arrangement for a respective output of the light from the lighting arrangement in opposite directions.

Thus, the first and second aspects of the present invention are based on the common concept or idea of providing a lamp unit with a gasket that has a cross-section with a step-wise shape in order to sealingly interact with components of the lamp unit in order to achieve an efficient sealing in multiple directions. More specifically, the gasket is configured to press the reflector towards the lid element by engaging with the engagement element of the reflector in an efficient manner.

The present invention is advantageous in that the first portion of the gasket and the second portion of the gasket provide sealing effects in two directions, perpendicular and parallel to the principal axis, A, of the reflector. In contrast to the prior art, which provides sealing in only one direction, the present invention uses the gasket to ensure a sealing solution which is less susceptible to water ingress.

Furthermore, the third portion of the gasket engages the engagement element of the reflector and presses the reflector towards the lid element, with the purpose of avoiding a gap between the reflector and the lid element. This is advantageous in that the lamp unit is configured to provide a more consistent light output from the lamp unit compared to the prior art where the light output often varies depending on how the lamp unit is directed.

It will be appreciated that the lamp unit of the present invention furthermore comprises relatively few components. The relatively low number of components is advantageous in that the lamp unit is relatively inexpensive to fabricate. Moreover, the lamp unit is easily assembled and disassembled, providing e.g. an easier recycling operation.

The lamp unit and the lighting arrangement according to the first and the second aspect of the present invention comprise a reflector. By the term "reflector", it is here meant an element, structure, unit, or the like, which is configured to distribute, scatter, spread, direct, refract, reflect and/or transfer light emitted from the light source(s) of the lamp unit. The reflector further comprises an engagement element. By the term "engagement element" it is meant, but not limited to, an element, device, unit, or the like, for engagement, interlocking, connecting, coupling, or the like. The lamp unit further comprises a gasket that has a cross-section with a step-wise shape in a plane perpendicular to the principal axis, A. By the term "step-wise shape" it is meant a shape that has at least three distinct parts that together make up a step-wise shape. It will be appreciated that the angle between the different parts may vary and it is to be understood that the step-wise shape may e.g. be Z-shaped, or the like. The lighting arrangement according to the second aspect of the present invention comprises two lamp units oppositely arranged. By the term "oppositely arranged", it is meant that the two lamp units are arranged at opposite positions in the lighting arrangement in such a way that the respective output of light from the lamp units is at least partially directed in opposite directions.

According to an embodiment of the present invention, the lid element may comprise at least one of a diffuser and a lens. By "diffuser" it is meant substantially any element comprising a material that is configured to diffuse and/or scatter light. By "lens" it is meant substantially any transmissive optical device that focuses or disperses light by means of refraction. The lens may comprise a material such as glass or plastic. The present embodiment is advantageous in that the light from the lamp unit may be softened across a relatively wide area by using a diffuser or dispersing lens and/or that the light may be focused by a focusing lens, resulting in an aesthetically appealing effect.

According to an embodiment of the present invention, the engagement element may be a flange portion. The flange portion may be arranged circumferentially around the reflector in a plane perpendicular to the principal axis, A, of the reflector. Accordingly, the meaning of the term "arranged circumferentially" describes that the flange portion runs around the whole reflector in a plane perpendicular to the principal axis, A. By "flange portion" it is here meant an external or internal ridge or rim (lip) for engagement with another object, element or portion. The present embodiment is advantageous in that the flange portion provides means for the gasket to push the reflector towards the lid element, which even to a higher extent reduces the risk of a gap occurring between the reflector and the lid element.

According to an embodiment of the present invention, the third portion of the gasket may comprise at least one cavity configured to receive the flange portion. By "cavity" it is here meant an indent, dimple, concavity, depression, hole, pit, recess, or the like, which is configured to at least partially receive the flange portion of the reflector. The present embodiment is advantageous in that the cavity provides an even higher degree of stability and an even more secure engagement of the lamp unit, leading to an even more efficient sealing of the lamp unit.

According to an embodiment of the present invention, the flange of the lid element may comprise two parts. The first part extends transverse, for example perpendicular, to the principal axis, A, and is arranged between the fastening element and the first portion of the gasket in a direction parallel to the principal axis, A. The second part extends along, for example parallel, to the principal axis, A, and is arranged between the second portion of the gasket and the reflector in a direction perpendicular to the principal axis, A. Hence, the first and second part of the flange are adjacently arranged at the rim of the reflector. The shape of the combination of the first and second part of the flange of the lid element may constitute an L-shape, which engages with the Z-shaped part of the gasket, in particular with the first and second portions of the gasket. The present embodiment is advantageous in that it provides a sealing effect of the lamp unit in two directions, both parallel and perpendicular to the principal axis, A, of the reflector.

According to an embodiment of the present invention, the fastening element may comprise a first set of threads, and the housing may comprise a second set of threads configured to receive the first set of threads. By "threads" it is here meant screw threads, which comprise a helical structure used to convert between rotational and linear movement or force. The term "threads" can also be interpreted as a ridge wrapped around a cylinder or cone. In the present embodiment, the sets of threads are used to attach the fastening element to the housing by rotation of the lid element relative to the housing. Alternatively, according to another embodiment of the present invention, the fastening element may comprise a snap connection. By "snap connection" it is here meant a device, unit, or the like for attaching flexible parts by forcing interlocking elements together, comprising cantilever, torsional and/or annular snap-fits, or the like. The fastening in these embodiments results in a force being applied on at least the flange of the lid element in a direction parallel to the principal axis, A. In the present embodiment, the applied force clamps at least the first part of the flange of the lid element and the gasket, between the fastening element and the housing. The present embodiment is advantageous in that it provides a convenient manner of fastening or attaching the fastening element to the housing.

According to an embodiment of the present invention, the lamp unit may further comprise a diffuser element arranged between the at least one light source and the reflector in a direction parallel to the principal axis, A. The diffuser element is arranged in the lamp unit such that the light from the light source during operation of the lamp unit is transmitted through the diffuser element before reaching the reflector.

According to an embodiment of the present invention, the flange may comprise at least one first protruding element being in engagement with the fastening element. By the term "protruding element" it is here meant that the flange may comprise a portion protruding and/or extending from the rest of the flange. The protruding element may, for example, be a bulge of the flange, a part or portion extending from the flange, or a part or portion biased towards the fastening element. The present embodiment is advantageous in that the protruding element may engage the fastening element in a way so that the force from the fastening element is directed through a specific part of the flange.

According to an embodiment of the present invention, the gasket may further comprise at least one second protruding element, and the housing may further comprise at least one first cavity configured to receive the at least one second protruding element of the gasket. By the term "cavity" it is here meant for example an indent, or the like, which is configured to, at least partly, matingly engage the second protruding element(s) of the gasket so that an interlocking between the second protruding element(s) and the cavity (ies) may occur. The present embodiment is advantageous in that it adds friction to the connection between the housing and gasket, thereby providing an even more stable lamp unit as the gasket may be held even more firmly in its intended position.

According to an embodiment of the present invention, the gasket may further comprise at least one third protruding element, and the flange may further comprise at least one second cavity configured to receive the at least one third protruding element. The present embodiment is advantageous in that the interlocking function between the third protruding element(s) and the second cavity(ies) adds stability to the sealing structure provided by the gasket, which in turn provides an even more robust lamp unit. The present embodiment is further advantageous as the dimensional length of the sealing provided by the gasket is increased which provides a better sealing effect of the lamp unit to protect against water ingress.

According to an embodiment of the present invention, the at least one light source may comprise at least one light-emitting diode, LED. The present embodiment is advantageous in that the LEDs compared to incandescent lamps, fluorescent lamps, neon tube lamps, etc., provide a longer operational life, a reduced power consumption, and an increased efficiency related to the ratio between light energy and heat energy.

According to an embodiment of the present invention, there is provided a lighting arrangement comprising two lamp units according to any one of the preceding embodiments. In this lighting arrangement, the lamp units are oppositely arranged for a respective output of the light from the system in opposite directions. The lamp units make use of the gasket described in the previous embodiments that is configured to press the reflector towards the lid element of the respective lamp unit. This is advantageous in that the light output of the respective lamp unit will be identical and independent of the angle or direction of orientation. Hence, by the lighting arrangement of the present embodiment, the lighting outputs in opposite directions are symmetrical, providing a desired lighting output from the lighting arrangement whilst providing an aesthetical appearance of the lighting output.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
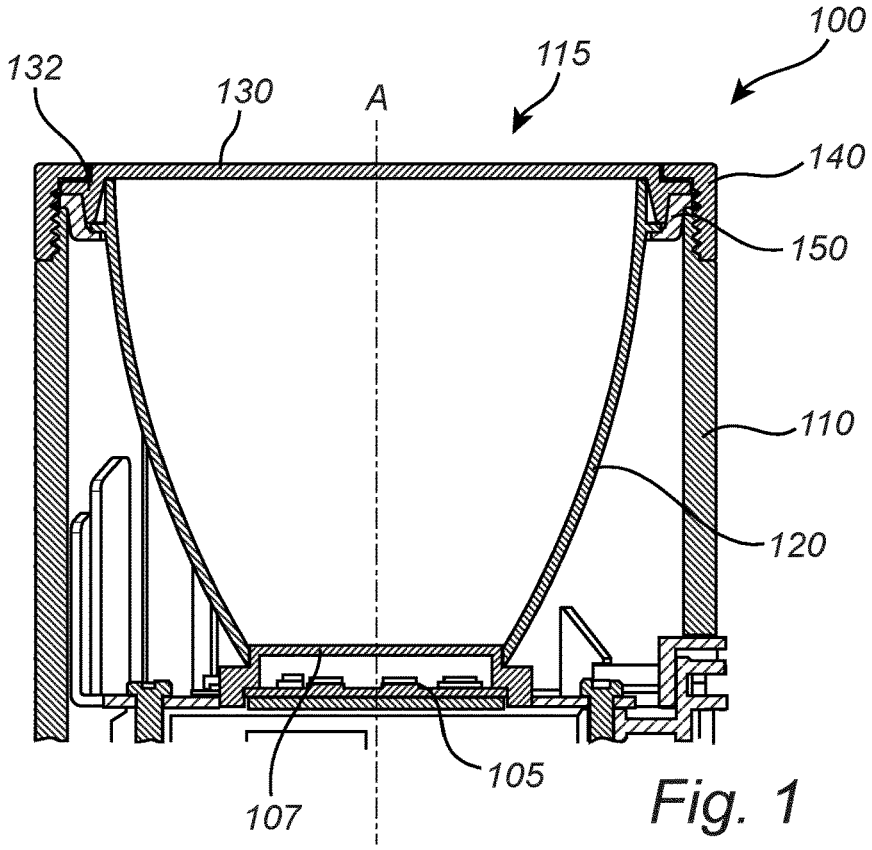
FIG. 1 schematically shows a cross-sectional view of a lamp unit according to an exemplifying embodiment of the present invention, FIG. 2 schematically shows a cross-sectional view of a part of a lamp unit according to an exemplifying embodiment of the present invention, FIG. 3 schematically shows a cross-sectional view of a part of a lamp unit according to an exemplifying embodiment of the present invention, FIG. 4 schematically shows a cross-sectional view of a part of a lamp unit according to an exemplifying embodiment of the present invention.

FIG. 1 shows a cross-sectional view of a lamp unit 100 according to an exemplifying embodiment of the present invention. The lamp unit 100 comprises at least one light source 105 which may constitute one or more LEDs. The lamp unit 100 further comprises a diffuser element 107 configured to diffuse the light emitted from the light source(s) 105 during operation. The lamp unit 100 further comprises a dome or cone-shaped reflector 120, elongating along a principal axis, A. The reflector 120 is configured to reflect the light emitted from the light source(s) 105 during operation. The reflector 120 comprises a first opening 115 for an output of the light emitted from the at least one light source 105. The lamp unit 100 further comprises a lid element 130 arranged on the first opening 115 of the reflector 120. The lid element 130 comprises a diffuser and/or a lens. The lid element 130 comprises a flange 132. The lamp unit 100 further comprises a housing 110 at least partially enclosing the reflector 120 in a circumferential direction of the principal axis, A. The lamp unit 100 further comprises a fastening element 140 biasedly engaged with the housing 110, wherein the flange 132 is at least partially arranged between the fastening element 140 and the housing 110 in a direction parallel to the principal axis, A. The lamp unit 100 further comprises a gasket 150 arranged circumferentially around the reflector 120 in a plane perpendicular to the principal axis, A, wherein a cross section of gasket 150 has a step-wise shape.

The gasket 150 of the lamp unit 100 of FIG. 1 is arranged between the housing 110 and the flange 132. The gasket 150 is configured to have a double sealing effect providing a seal in two directions of the lamp unit 100, parallel and perpendicular to the principal axis, A. The double sealing effect of the gasket 150 provides an advantageous way of preventing water ingress of the lamp unit 100. The gasket 150 is further configured to press the reflector 120 towards the lid element 130. When the reflector 120 is pushed towards the lid element 130 by the gasket 150, the gap between them is minimized. This is beneficial for the lighting output of the lamp unit 100 which becomes more consistent.

Figure 2:
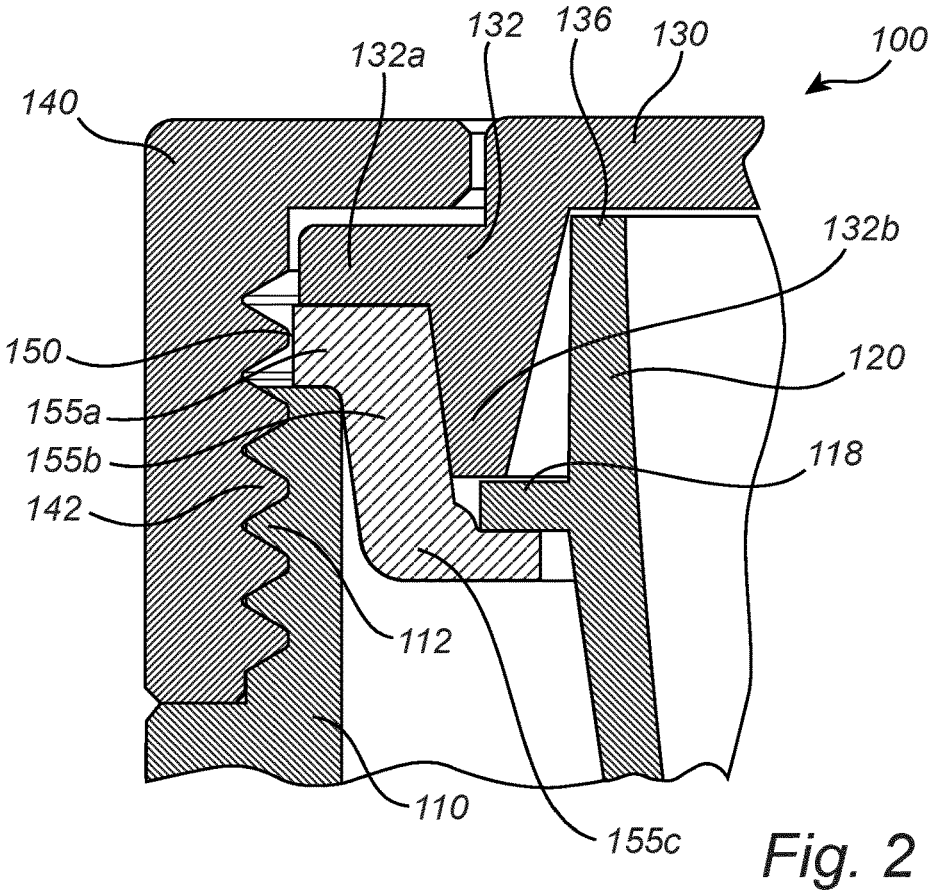

FIG. 2 shows a cross-sectional view of a part of the lamp unit 100 in FIG. 1 according to an exemplifying embodiment of the present invention. In accordance with the example of FIG. 1, the reflector 120 of the lamp unit 100 elongates along a principal axis, A. The reflector 120 comprises an engagement element 118 arranged circumferentially around the reflector 120 in a plane perpendicular to the principal axis, A. The lid element 130 of the lamp unit 100 comprises a flange 132. The housing 110 of the lamp unit 100 at least partially encloses the reflector 120 in a circumferential direction of the principal axis, A. Furthermore, in accordance with the lamp unit 100 of FIG. 1, the fastening element 140 of the lamp unit 100 in FIG. 2 biasedly engages with the housing 110. The flange 132 is at least partially arranged between the fastening element 140 and the housing 110 in a direction parallel to the principal axis, A. The fastening element 140 is configured to bias the flange 132 in a direction parallel to the principal axis, A. The fastening element 140 comprises a first set of threads 142 and the housing 110 comprises a second set of threads 112, wherein the first and second sets of threads 142, 112 are configured to matingly engage upon fastening of the fastening element 140 to the housing 110. The flange 132 comprises a first part

132*a* extending transverse, in the figure perpendicular, to the principal axis, A, and a second part 132*b* extending along, in the figure parallel, to the principal axis, A. It will be appreciated that the flange 132 may alternatively have different shapes, as long as the cross section of the flange 132 at least comprises the first part 132*a* and the second part 132*b*.

In accordance with the lamp unit 100 of FIG. 1, the gasket 150 in FIG. 2 is arranged circumferentially around the reflector 120 in a plane perpendicular to the principal axis, A. The gasket 150 comprises a first portion 155*a* extending at least partially transverse, in the figure perpendicular, to the principal axis, A. The gasket 150 further comprises a second portion 155*b* extending at least partially along the principal axis, A. The gasket 150 further comprises a third portion 155*c* extending at least partially transverse to the principal axis, A. Thus, the gasket 150 has an at least partially step-wise shape (or Z-like shape) in a cross-section of the plane perpendicular to the principal axis, A. The flange 132 is configured to engage with the gasket 150. The first part 132*a* is configured to engage with the first portion 155*a* and the second part 132*b* is configured to engage with the second portion 155*b*, thus creating a double sealing effect of the lamp unit 100. The third portion 155*c* is configured to engage with the engagement element 118 in order to press the reflector 120 towards the lid element 130. The third portion 155*c* may comprise at least one cavity (not shown), configured to matingly receive at least a portion of the engagement element.

Figure 3:
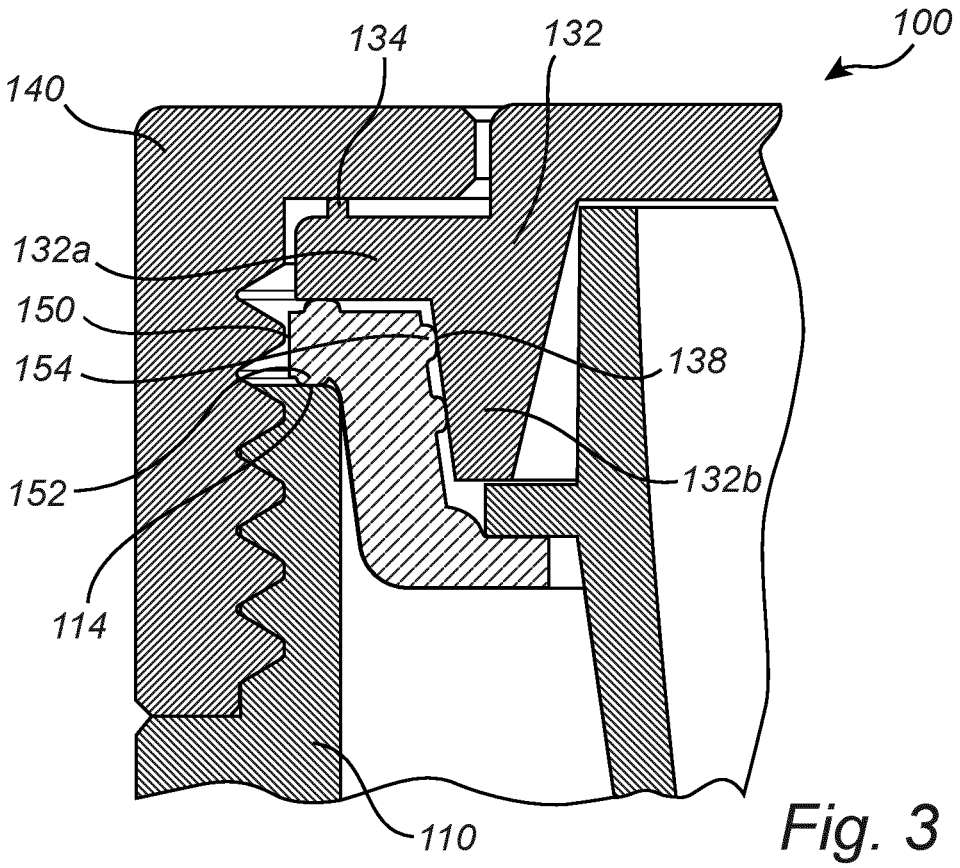

FIG. 3 shows a cross-sectional view of a part of the lamp unit 100 according to an exemplifying embodiment of the present invention. It will be appreciated that the lamp unit 100 of FIG. 3 is similar to that shown in FIG. 2, and it is referred to FIG. 2 and the associated text for a more detailed description of the specific features. The first part 132*a* of the flange 132 in FIG. 3 comprises a first protruding element 134 arranged circumferentially around the first principle axis, A, wherein the first protruding element 134 is in engagement with the fastening element 140. The first protruding element 134 is not considered to be limited by the figure, and it should be noted that the first protruding element 134 may be e.g. a bulge of the flange 132, a part or portion extending from the flange 132, a part or portion biased towards the fastening element 140, or the like. The gasket 150 further comprises at least one second protruding element 152, and the housing 110 further comprises at least one second cavity 114 (not shown) configured to receive the at least one second protruding element 152. It is to be understood that the shape of the second protruding element 152 and the second cavity 114 may vary between different embodiments, and it should be clear to the skilled person to create other shapes for engaging the two. The gasket 150 according to FIG. 3 further comprises three third protruding elements 154, and the flange 132 further comprises three corresponding second cavities 138 (not shown) configured to receive the third protruding elements 154. It is to be understood that the shape(s) of the third protruding elements 154 and the shape(s) of the second cavities 138 may vary between different embodiments, and it should be clear to the skilled person that other shapes than those indicated may be feasible for engagement. It is also understood that the protruding elements 152, 154 could be at least one of a single ridge arranged circumferentially around the first principle axis, A, and a set of protruding elements arranged on a circumferential plane around the principle axis, A. Correspondingly, the second cavities 114, 138 could be at least one of a single continuous cavity arranged circumferentially around the first principle axis, A, and set of cavities arranged on a circumferential plane around the principle axis, A, configured to receive the protruding elements 152, 154.

Figure 4:
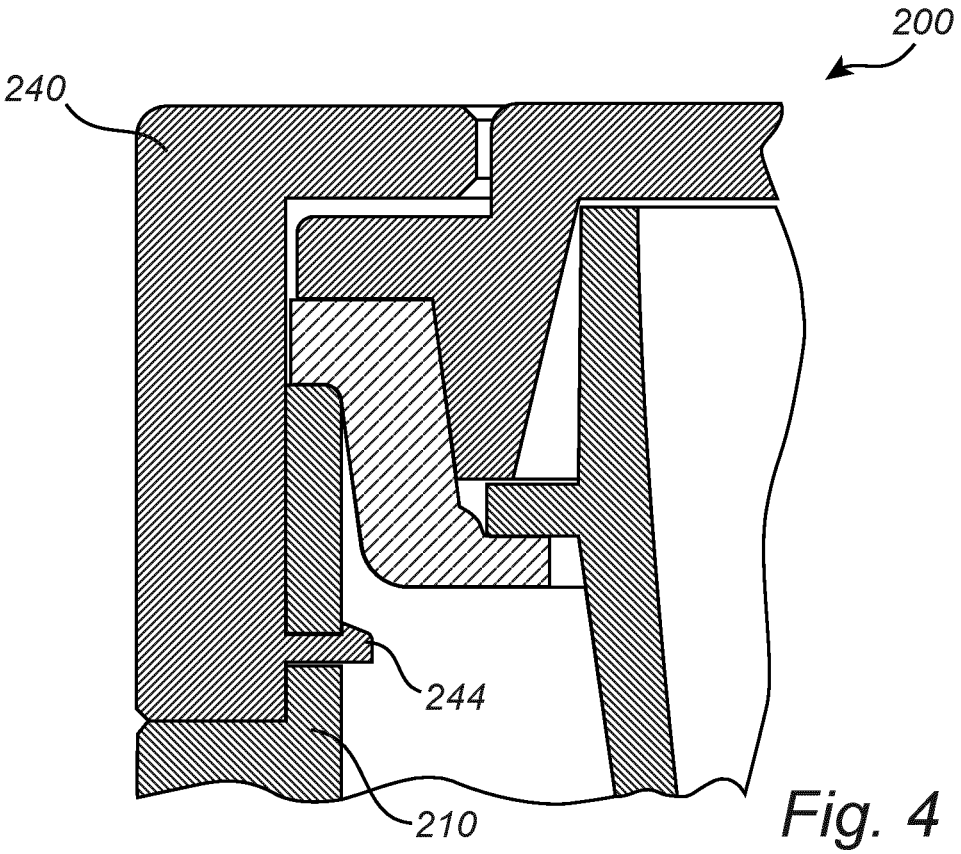

FIG. 4 shows a cross-sectional view of a part of a lamp unit 200 according to an exemplifying embodiment of the present invention. The lamp unit 200 of FIG. 4 is similar to the lamp unit 100 shown in FIG. 2, and it is referred to FIG. 2 and the associated text for a more detailed description of the specific features. The fastening element 240 of the lamp unit 200 differs from the fastening element in FIG. 2 in that the fastening element 240 comprises a snap connection 244 configured to be fastened to the housing 210. The snap connection 244 could e.g. be at least one of a cantilever connection, torsional connection and annular snap-fit connection, or the like. It is to be understood that the fastening element 240 and the housing 210 could have an inverse relationship and/or inverse configuration than that exemplified in FIG. 4, i.e. opposite functions of the fastening element 240 and the housing 210. Hence, the housing 210 may be configured to be fastened to the fastening element 240.

Figure 5:
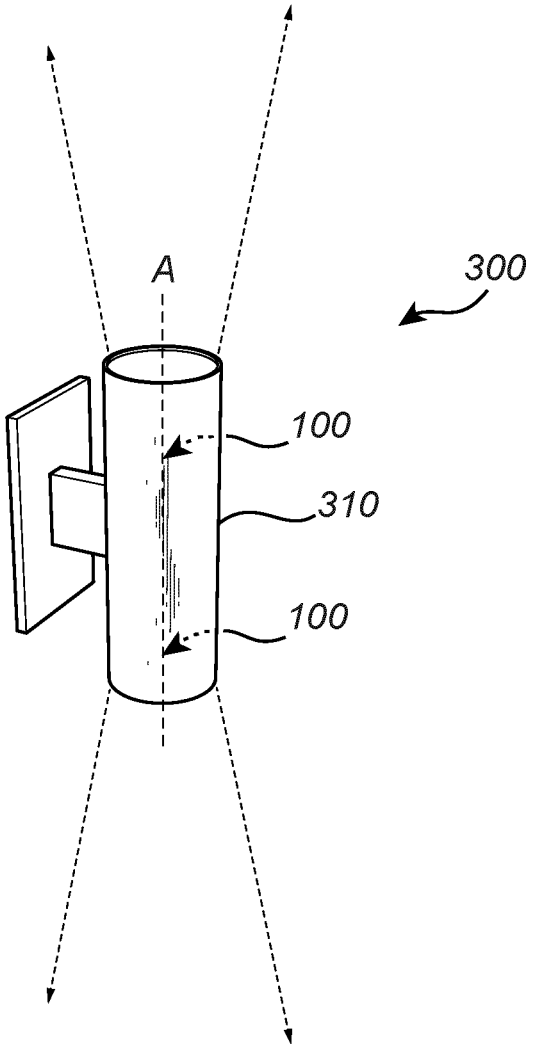
FIG. 5 shows an exemplary lighting system comprising two lamp units.

FIG. 5 shows an exemplary lighting arrangement 300 comprising two lamp units 100 according to any of the previously discussed embodiments. The lighting arrangement 300 comprises a cylinder-shaped housing 310 which elongates along a principle axis, A. It will be appreciated that the housing 310 may constitute the housing 110 as exemplified in one or more of the previously described embodiments. Alternatively, the housing 310 may enclose the housing 110. The lamp units 100 are provided at oppositely arranged positions within the lighting arrangement 300 with respect to the principle axis, A. Hence, the lamp units 100 are arranged to emit light from the lighting arrangement 300 in opposite directions. The lamp units 100 make use of the gaskets described in the previous embodiments, whereby the gaskets are configured to press the reflectors towards the lid elements, respectively. This creates a lighting output from the lighting arrangement 300 that is symmetric. For example, in case the lighting arrangement 300 is arranged as exemplified in FIG. 5, i.e. wherein the principle axis, A, is vertical, the lighting arrangement 300 is configured to emit light which is symmetric in the upwards and downwards directions. It is understood that the skilled man would be able to consider other directions for the lamp units 100 and/or other lighting arrangements 300 comprising more than two lamp units in order to provide other lighting outputs.

The invention claimed is:

1. A lamp unit, comprising at least one light source, a reflector configured to reflect the light emitted from the at least one light source, wherein the reflector elongates along a principal axis, A, and comprises a first opening for an output of the light emitted from the at least one light source, and an engagement element arranged circumferentially around the reflector in a plane perpendicular to the principal axis, A, a lid element arranged on the first opening of the reflector, the lid element comprising a flange arranged at a rim of the reflector at the first opening, a housing at least partially enclosing the reflector in a circumferential direction of the principal axis, A, a fastening element biasedly engaged with the housing, wherein the flange is at least partially arranged between the fastening element and the housing in a direction parallel to the principal axis, A, and wherein the fastening element is configured to bias the flange in a direction parallel to the principal axis, A, and a gasket arranged circumferentially around the reflector in a plane perpendicular to the principal axis, A, wherein the gasket has a step-wise shape in a cross-section of the plane and comprises a first portion extending transverse to the principal axis, A, and being arranged between the flange and the housing in a direction parallel to the principal axis, A, a second portion extending along the principal axis, A, and being arranged between the housing and the flange in a direction perpendicular to the principal axis, A, and a third portion extending transverse to the principal axis, A, and being engaged with the engagement element, wherein the fastening element is configured to clamp the first portion between the flange and the housing in a direction parallel to the principal axis, A, and to clamp the second portion between the housing and the flange in a direction perpendicular to the principal axis, A, and wherein the third portion, via the engagement element, is configured to press the reflector towards the lid element.

2. The lamp unit according to claim 1, wherein the engagement element is a flange portion.

3. The lamp unit according to claim 2, wherein the third portion comprises a cavity configured to receive the flange portion.

4. The lamp unit according to claim 1, wherein the lid element comprises at least one of a diffuser and a lens.

5. The lamp unit according to claim 1, wherein the flange comprises a first part extending transverse to the principal axis, A, and being arranged between the fastening element and the first portion in a direction parallel to the principal axis, A, and a second part extending along the principal axis, A, and being arranged between the second portion and the reflector in a direction perpendicular to the principal axis, A.

6. The lamp unit according to claim 1, wherein the fastening element comprises a first set of threads, and wherein the housing comprises a second set of threads configured to receive the first set of threads.

7. The lamp unit according to claim 1, wherein the fastening element is configured to be fastened to the housing via a snap connection.

8. The lamp unit according to claim 1, wherein the lamp unit further comprises a diffuser element arranged between the at least one light source and the reflector in a direction parallel to the principal axis, A.

9. The lamp unit according to claim 1, wherein the flange further comprises at least one first protruding element being in engagement with the fastening element.

10. The lamp unit according to claim 1, wherein the gasket further comprises at least one second protruding element, and the housing further comprises at least one first cavity, wherein the at least one first cavity is configured to receive the at least one second protruding element.

11. The lamp unit according to claim 1, wherein the gasket further comprises at least one third protruding element, and the flange further comprises at least one second cavity, wherein the at least one second cavity is configured to receive the at least one third protruding element.

12. The lamp unit according to claim 1, wherein the at least one light source comprises at least one light-emitting diode, LED.

13. A lighting arrangement, comprising two lamp units according to claim 1, wherein the lamp units are oppositely arranged in the lighting arrangement for a respective output of the light from the lighting arrangement in opposite directions.

* * * * *